US005096133A

United States Patent [19]

Horak et al.

[11] Patent Number: 5,096,133

[45] Date of Patent: Mar. 17, 1992

[54] TEXTILE WINDING MACHINE WITH APPARATUS FOR REMOVING DEBRIS ON AND AROUND A TRAVELING YARN

[75] Inventors: Dieter Horak, Mönchengladbach; Hans-Heinz Schäfer, Schwalmtal, both of Fed. Rep. of Germany

[73] Assignee: W. Schlafhorst AG & Co., Mönchengladbach, Fed. Rep. of Germany

[21] Appl. No.: 673,903

[22] Filed: Mar. 22, 1991

[30] Foreign Application Priority Data

Mar. 22, 1990 [DE] Fed. Rep. of Germany ..... 4009170

[51] Int. Cl.[5] ..... B65H 54/02; B65H 49/02

[52] U.S. Cl. ..... 242/18 R; 242/35.6 R; 242/128; 57/304

[58] Field of Search ..... 242/18 R, 128, 35.5 R, 242/35.5 A, 18 AA, 35.6 R, 35.6 E; 57/304, 305; 28/222, 223

[56] References Cited

U.S. PATENT DOCUMENTS 3,069,104 12/1962 Martin ..... 242/18 R 4,673,138 6/1987 Ichiba ..... 242/35.5 R 4,917,326 4/1990 Kojima et al. ..... 242/128

*Primary Examiner*—Stanley N. Gilreath

*Attorney, Agent, or Firm*—Shefte, Pinckney & Sawyer

[57] ABSTRACT

A debris removing apparatus for a textile winding machine is provided and includes an air stream channeling device, an air drive device, and a structure forming an opposite opening. The air stream channeling device includes an intake opening and a pair of wall members each having a generally planar portion extending substantially parallel to a lateral plane on which a linear travel path of a yarn lies as the yarn travels between a supply package to another yarn package at a winding station of the textile machine. The generally planar portions channel air drawn in through the intake opening by the air drive device into an air stream which travels parallel to the lateral plane toward the traveling yarn. The air stream flows around the yarn and entrains debris on and around the yarn for transport away from the yarn. The air drive device, in one aspect of the invention, includes a suction housing through which suction is applied.

11 Claims, 4 Drawing Sheets

TEXTILE WINDING MACHINE WITH APPARATUS FOR REMOVING DEBRIS ON AND AROUND A TRAVELING YARN

BACKGROUND OF THE INVENTION

The present invention relates to a textile winding machine having an apparatus for removing debris on and around a traveling yarn and, more specifically, an apparatus for applying a stream of air transversely to the direction of travel of a traveling yarn as the yarn travels from a supply package to another yarn package to effect removal of debris borne along with the traveling yarn.

U.S. Pat, No. 4,917,326 to Kojima et al discloses a cover for covering the top portion of supply package positioned at the winding station of a textile winding machine for removing fluff generated during the winding of yarn from the supply package to another yarn package. A suction pipe is connected to the cover for suctioning away fluff (e.g., fine debris particles) which are generated during the unwinding of the yarn from the supply package.

U.S. Pat. No. 4,673,138 to Ichiba discloses an apparatus for preventing the scatter of fly in a winder. An upper member having an open bottom end is disposed around a yarn tensioning device above the supply package being unwound. A lower member at least partially surrounds the supply package and has a top open end open towards the bottom open end of the upper cover member. Suction is applied to the interior of the upper cover member to create a fluid flow through the interior of both the upper and lower cover members to thereby remove fly generated within the two cover members.

However, neither the fluff scattering preventing apparatus disclosed in Kojimi et al nor the fly scatter preventing apparatus disclosed in Ichiba satisfactorily address the problems associated with the removal of debris which is typically carried along by a traveling yarn such as, for example, a yarn being wound from a supply package during winding of the yarn onto another yarn package on a textile winding machine The velocity of the traveling yarn tends to create a column of air surrounding the circumference of the traveling yarn whose direction of flow is the same as the direction of travel of the traveling yarn. This column air entrains debris, and in particular, entrains fine particle debris, and transports this debris therealong as the column of air flows along the circumference of the traveling yarn.

So long as the traveling yarn travels in an essentially linear travel path, the column of air flowing therewith remains undisturbed and the debris entrained in the column of air is transported thereby until the traveling yarn reaches other locations along the textile winding machine at which it changes its direction of travel or comes into engagement with a compound of the textile winding machine. In this manner, components as yarn tensioning devices, yarn break, and other components which are typically disposed between a supply package and the feed yarn package for handling of the yarn, tend to accumulate debris which has been dislodged from the traveling yarn. The accumulated debris on these components detrimentally impacts their operational deficiency.

Moreover, if the traveling yarn has not been cleaned of such accompanying debris before traveling into engagement with or past such components, the resulting turbulence caused by the engagement of the traveling yarn with these components tends to cause a relatively wide dispersal of the debris entrained with the column of air, thus further complicating the removal of such debris from the components Accordingly, the need exists for dislodging debris traveling with a yarn as it travels between two locations such as, for example, from a supply package to another yarn package.

SUMMARY OF THE INVENTION

The present invention provides a textile winding machine having a debris removing apparatus which advantageously removes debris on and around a traveling yarn by directing an air stream around the yarn.

Briefly described, the present invention provides, a textile winding machine comprising a winding station having means for winding yarn from a supply package onto another yarn package, the yarn traveling along a linear travel path during at least a portion of its travel between the supply package and the other yarn package and an apparatus for removing debris traveling with the yarn as it travels from the supply package to the other yarn package. The apparatus includes air stream channeling means including an intake opening, a first wall member, and a second wall member, an air drive means and a means forming an opposite side opening.

Each first and second wall member has a generally planar portion extending substantially parallel to a lateral plane on which the linear travel path lies on a respective side of the lateral plane and each generally planar portions is at least partially coextensive with the linear travel path in the direction of travel of the yarn, the generally planar portions forming therebetween an air stream channeling chamber intersected by the lateral plane and extending laterally to one side of the linear travel path. The air stream channeling chamber is communicated with the intake opening and open toward the yarn traveling along the linear travel path.

The air drive means drives air through the intake opening, along the air stream channeling chamber and into and around the yarn traveling along the linear travel path, the air stream channeling chamber channeling air into an air stream traveling parallel to the lateral plane toward the yarn in the linear travel path. The means forming an opposite side opening forms an opening on the opposite side of the linear travel path as the air stream channeling chamber relative to the lateral plane, the opposite side opening being intersected by the lateral plane and having a cross sectional extent relative to the cross sectional extent of the air stream channeling chamber to permit the air stream channeled by the air stream channeling chamber toward the yarn to flow around the yarn and entrains debris on and around the yarn for transport away from the yarn.

The textile winding machine preferably also includes a yarn braking device for controlling the rate of travel of the yarn as it travels between the supply package and the other yarn package, and the means forming an opposite side opening includes a pair of interconnecting portions, each the interconnecting portion being connected to a respective one of the first and second wall members and to the means forming an opposite side opening and each the interconnecting portion defines one edge of the opposite side opening on a respective side of the lateral plane Also, each interconnecting portion preferably extends from the generally planar portion of a respective one of the first and second wall members outwardly relative to the lateral plane to the means forming an opposite side opening.

According to one aspect of the present invention, the generally planar portions of the first and second wall members are at a spacing from one another greater than the cross-sectional extent of the yarn.

According to another aspect of the present invention, the textile winding machine further comprises a means forming a chamber in which the supply package is disposed during winding of yarn therefrom, the chamber extending beyond the top of the supply package relative to the direction of travel of the yarn, and the air stream channeling means is disposed intermediate the chamber forming means and the yarn braking device.

According to a further aspect of the present invention, the air drive means is a suction applying device for applying suction through the air stream channeling means.

The textile winding machine preferably also includes a yarn end splicing end device and a yarn end engaging device having an arm member pivotally mounted to the textile winding machine for pivoting in a plane parallel to the lateral plane, the arm member forming a suction conduit and a free end of the arm member defining a suction opening at the end of the suction conduit. The arm member is pivotable between a yarn end engaging position in which the suction opening of the arm member is disposed intermediate the debris removing apparatus and the chamber forming means for applying suction to draw a yarn end of the yarn into the suction conduit of the arm member and a yarn transfer position in which the suction opening of the arm member is disposed for positioning the yarn engaged by the arm member in the yarn end splicing device.

According to an additional aspect of the present invention, the textile winding machine includes a balloon breaking device located intermediate the chamber forming means and the debris removing apparatus.

According to yet another aspect of the present invention, the textile winding machine includes a slub catcher mounted to the chamber forming means for removing yarn slubs as the yarn travels from the supply package to the other yarn package.

According to a further additional aspect of the present invention, the textile winding machine includes a cover portion extending between, and connected to, the interconnecting portions. The cover portion preferably includes a yarn guiding element for guiding the yarn as it travels between the supply package and the other yarn package.

DESCRIPTION OF THE PREFERRED EMBODIMENT

Figure 1:
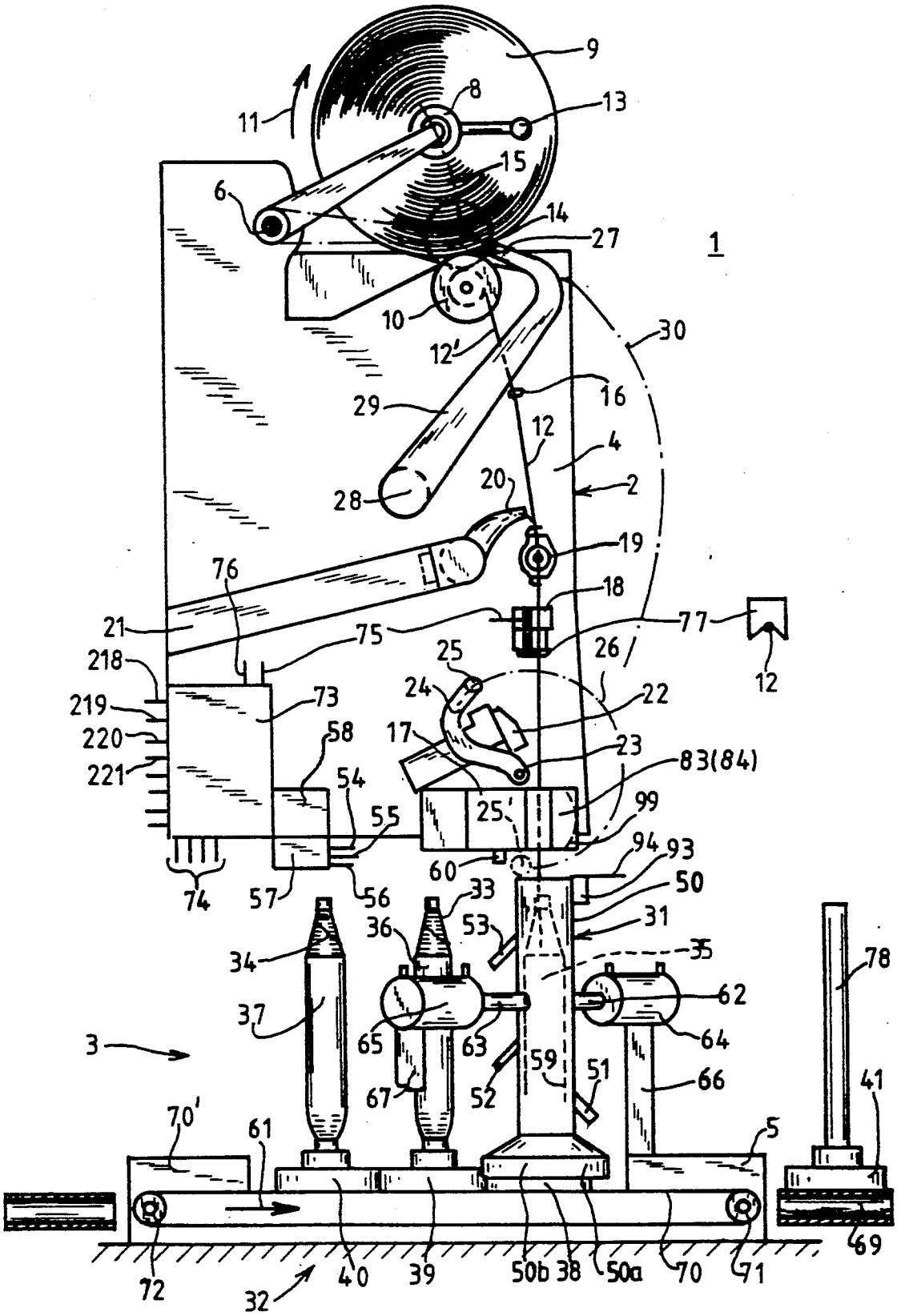
FIG. 1 is a side elevational view of a winding station of a textile winding machine having the preferred embodiment of the debris removing apparatus of the present invention.
Figure 2:
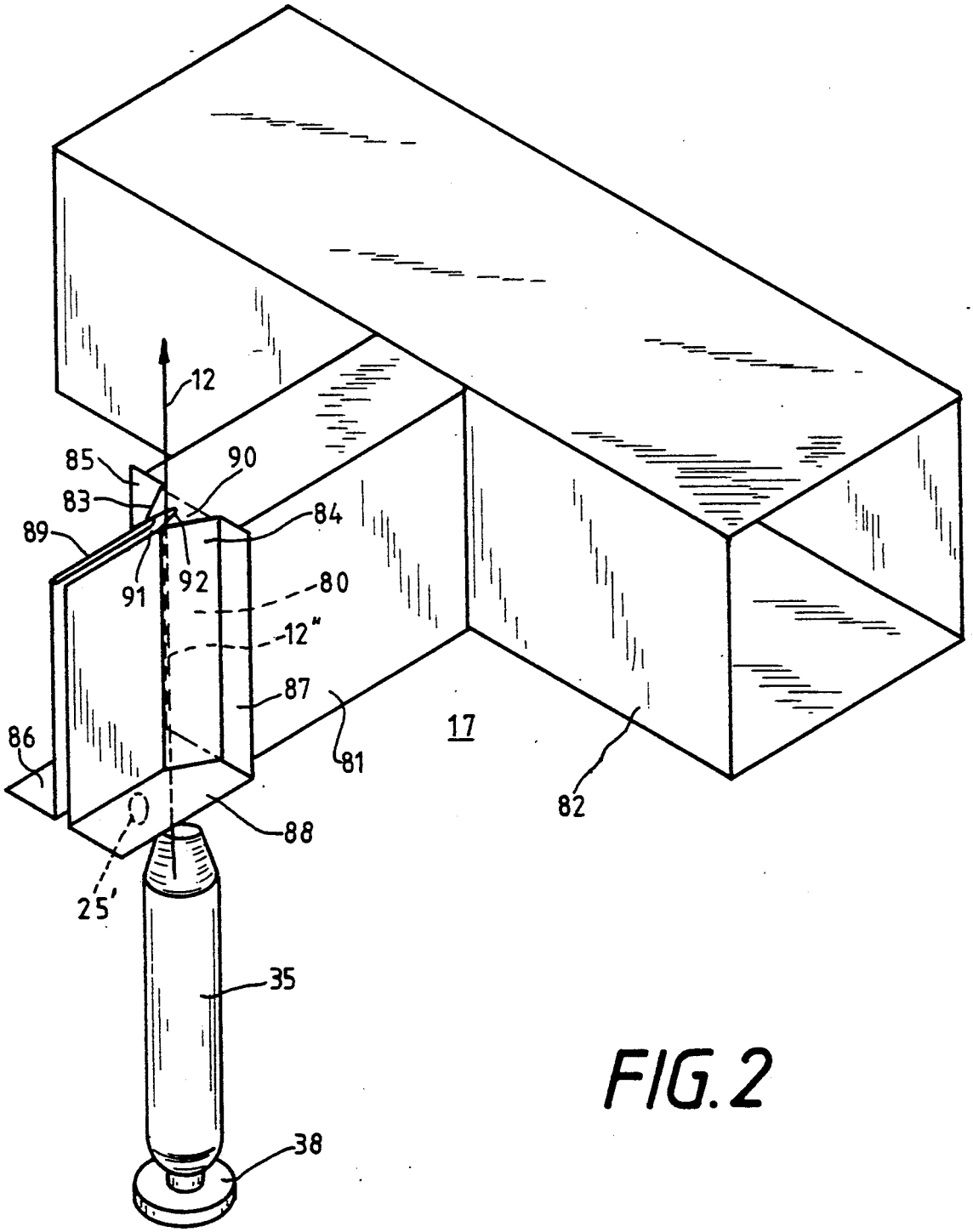
FIG. 2 is an enlarged perspective view of the debris removing apparatus shown in FIG. 1 and showing the supply package from which the traveling yarn is drawn.
Figure 3:
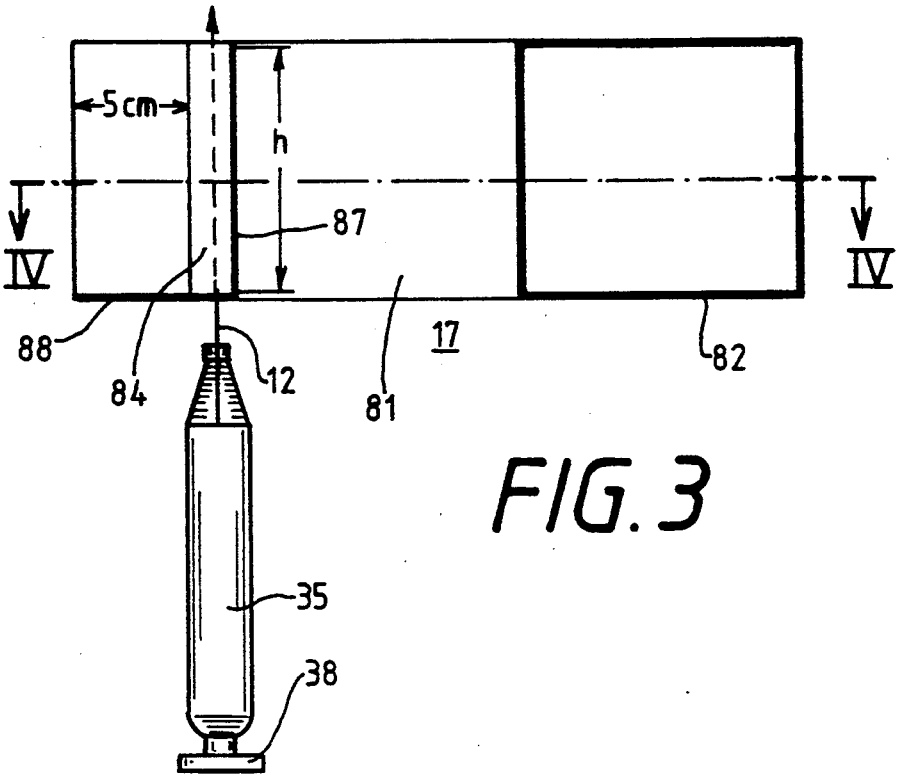
FIG. 3 is a side elevational view of the debris removing apparatus shown in FIG. 2.
Figure 4:
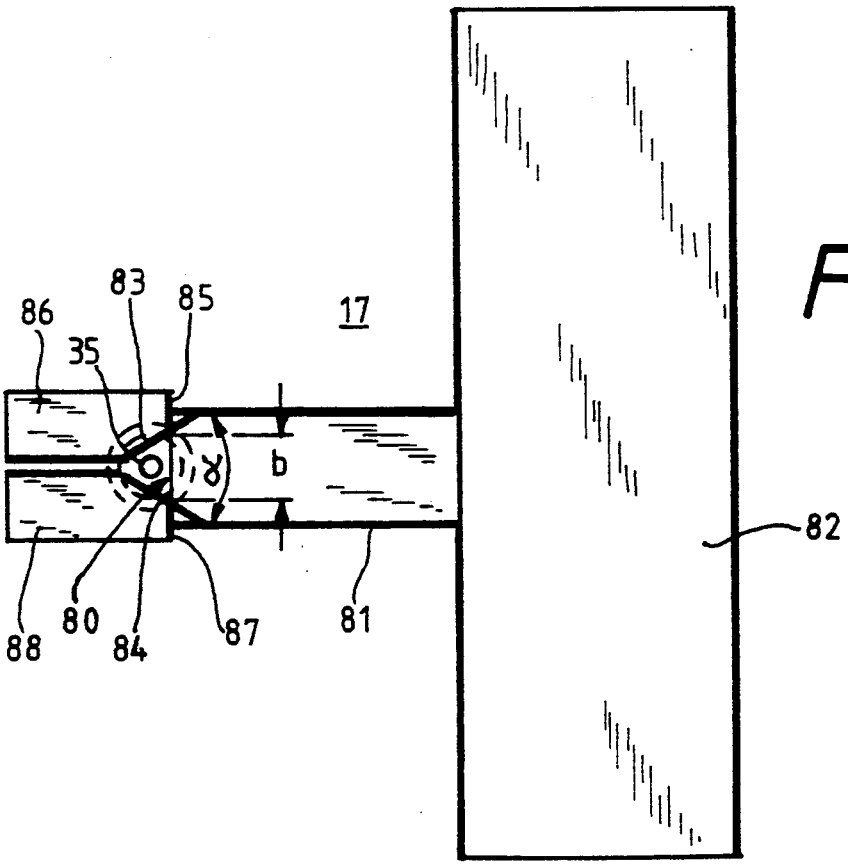
FIG. 4 is a horizontal sectional view of the debris removing apparatus, taken along lines IV—IV of FIG. 3.

In FIG. 1, a textile winding machine I having a winding station 2 is illustrated. The textile winding machine 1 includes the preferred embodiment of the debris removing apparatus 17 of the present invention and FIGS. 2–4 illustrate the features of the debris removing apparatus in greater detail.

The textile winding machine 1 includes a conventional yarn package transport assembly 3 for transporting yarn packages to the winding station 2 for unwinding thereat. The winding station 2 is mounted on a frame 4 and includes a rocking shaft 6 of a creel 8 mounted on a machine frame 4 and carrying the tube of a cross-wound bobbin 9. The bobbin 9 is in contact with a yarn guide drum 10 and is driven by the yarn guide drum 10 by means of friction in the direction indicated by the arrow 11. The yarn guide drum 10 is provided with reversing thread grooves for guiding a yarn 12 from a package being unwound at the unwinding location onto the bobbin 9 as a cross-wound bobbin. The creel 8 is raised by a handle 13 to lift the bobbin 9 off the yarn guide drum 10.

At the start of winding, an empty tube 14 is clamped into the creel 7, as is shown in FIG. 1 in dotted lines. As the bobbin 9 is built, the creel 8 pivots upward along a circular arc 15.

The yarn 12 is supplied to the yarn guide drum 10 through a yarn eyelet 16. Yarn 12 traverses along a path 12' as it travels between the yarn eyelet 16 and the yarn guide drum 10.

As it comes from the yarn supply unit 3, yarn 12 runs through a conventional clearer 18 and a conventional waxing device 19 before it reaches yarn eyelet 16. In the event of a yarn break, the yarn can be drawn into a suction nozzle 20 which is connected to a conventional suction source 21.

To restore a yarn connection after a yarn break, a conventional splicing device 22 is located to the side of the yarn or thread course between the yarn tensioner 17 and the clearer 18. This splicing device 22 operates automatically in a conventional manner.

After a yarn break, the incoming yarn end is usually still present under the clearer 18. It is caught there for the purpose of splicing by a conventional yarn receiving element in the shape of a suction tube 24 which can pivot about a pivot 23 and whose suction intake mouth 25 is pivoted along circular arc 26 below the yarn clearer 18 and back again into the initial position.

The upper yarn end has usually been wound onto the winding bobbin 9 after a yarn break. It is drawn in by suction by a suction intake nozzle 27 of a suction tube 29, which pivots about a pivot point 28. When the suction tube 29 is pivoted downward, the suction intake nozzle 27 moves with the engaged upper yarn along a circular arc 30. The entrained yarn is threaded thereby into the reversing thread groove of the yarn guide drum 10, the yarn eyelet 16, the waxing device 19 and the measuring slot of the clearer 18. It is also grasped by a conventional grasping means (not shown) of the splicing device 22 adjacent the lower yarn held by the suction intake mouth 25 of the suction tube 24. Immediately after restoration of the splicing connection, the splicing device 22 frees the yarn for resumption of the winding operation.

The winding station 2 includes a plurality of independently movable tube support members 38,39 and 40 for individually supporting a plurality of yarn packages 35,36 and 37, respectively, which comprise yarn built on an individual tube. Each yarn package 35–37 includes an upper reserve winding such as, for example, the upper reserve windings 33 and 34 on the yarn packages 36 and 37, respectively. As seen in FIG. 1, each tube support member 38,39,40, includes a cylindrical base plate, a top cylindrical plate, and a cylindrical upright component, the plates and the upright cylindrical component 45 being coaxial. The upright component has an outer diameter compatibly configured with respect to the inner diameter of the tubes onto which the yarn of the yarn packages 35–37 is built. Accordingly, the tube support members 38–40 individually support the yarn packages 35–37 in an upright disposition.

As seen in FIG. 1, the winding station 2 includes a conventional delivery assembly 68 having an endless belt for delivering the tube support members 38–40 to a preliminary location, a conventional discharge assembly 69 having an endless belt for transporting the tube support members 38–40 from a discharge location to a further handling location (not shown) and a cross-transport assembly 32 for transporting the tube support members 38–40 along a cross path extending from the preliminary location through an unwinding location to the discharge location. The cross-transport assembly 32 transports the tube support members 38–40, with the yarn packages 35–37 supported in upright dispositions thereon, to the unwinding location for individual unwinding of the yarn packages at the winding station 2.

The cross-transport assembly 32 includes an endless belt 70 trained around a pair of guide rollers 71,72 and driven by a conventional endless belt drive motor (not shown) in the direction indicated by the arrow 61 in FIG. 1. The junction of the delivery assembly 68 and the cross-transport assembly 32 defines the preliminary location. The tube support members 38–40 are transferred from the endless belt of the delivery assembly 68 to the endless belt 70 of the cross-transport assembly 32, at the preliminary location, in conventional manner. The junction of the endless belt of the discharge assembly 69 and the endless belt 70 of the cross-transport assembly 32 defines the discharge location. The tube support members 38–40 are transferred from the endless belt 70 of the cross-transport assembly 32 to the endless belt of the discharge assembly 69, at the discharge location, in conventional manner.

As seen in FIG. 1, the yarn end loosening apparatus 3 includes a support frame 5, a first support post 66 extending vertically from the support frame 5 and supporting a first movement means 64, a connector 62 and a first chamber portion 50*a* and a second support post 67 supporting a second movement means 65, a second connector 64 and a second chamber portion 50*b*. The first chamber portion 50*a* and the second chamber portion 50*b* form a gas guide chamber 50 when they are in mating contact with one another. The first movement means 64 and the second movement means 65 are each configured as a conventional hydraulic cylinder actuable to selectively retract and extend the respective associated connector 62 or 63, which are each configured as conventional hydraulic cylinder rods. The first movement means 64 and the second movement means 65 are each operatively connected by a plurality of conventional connectors 74 to a central control unit 73 mounted to the winding station 2. The connector 74 can be, for example, flexible pneumatic conduits.

The first chamber portion 50*a* is fixedly connected to the free end of the connector 62. The second chamber portion 50*b* is fixedly connected to the free end of the connector 63. As seen in FIG. 1, the first chamber portion 50*a* and the second chamber portion 50*b* support a plurality of jet nozzles 51,52 and 53 which are operatively connected by a plurality of flexible conduits 54,55 and 56, respectively, to a conventional regulating valve 57. The regulating valve 57 regulates the outflow of compressed gas from a conventional compressed gas source 58 operatively connected to the central control unit 73. The jet nozzles 51,52 and 53 direct jet streams of gas, which are supplied via the conduits 54,55 and 56 from the compressed gas source 58, against a yarn package positioned between the first chamber portion 50*a* and the second chamber portion 50*b* to loosen a yarn end on the yarn package, as described in more detail below.

As seen in FIG. 1, the first chamber portion 50*a* and the second chamber portion 50*b* are respectively movable to a chamber forming position in which they define the gas guide chamber 50. In this regard, as seen in FIG. 1, the first chamber portion 50*a* includes a semi-cylindrical body portion having an axial extent greater than the length of any of the tubes supported on the tube support members 38,39,40 and an enlarged foot portion having a radial extent greater than the radial extent of the semi-cylindrical body portion. As seen in FIG. 1, the enlarged foot portion has a radial extent sufficient to accommodate the base plate and the top plate of a respective one of the tube support members 38,39,40 when the tube support member is positioned between the first chamber portion 50*a* and the second chamber portion 50*b* in the gas guide chamber 50.

The second chamber portion 50*b* includes a semi-cylindrical body portion and, as shown in FIG. 1, an enlarged foot portion having a radial extent greater than the radial extent of the semi-cylindrical portion. The radial extent of the enlarged foot portion is sufficient to accommodate the base plate and the top plate of a respective one of the tube support members 38,39,40 when the respective tube support member is positioned in the gas guide chamber 50.

The first chamber portion 50*a* and the second chamber portion 50*b* are compatibly configured with their respective semi-cylindrical body portions having the same radius and their respective enlarged foot portions having the same cross sectional radial extent, such that the semi-cylindrical body portions and the enlarged foot portions, respectively, mate with one another along a first interface line 59 and a second interface line 60 when the first chamber portion 50*a* and the second chamber portion 50*b* are moved into the chamber forming position to form the gas guide chamber 50. As seen in FIG. 1, the free end of the connector 62 is fixedly connected to the semi-cylindrical body portion of the first chamber portion 50*a* and the connector 63 is fixedly connected to the semi-cylindrical body portion of the second chamber portion 50*b* such that the semi-cylindrical body portions are supported in a vertical disposition. Thus, the gas guide chamber 50 includes a cylindrical portion, formed by the semi-cylindrical portions of the chamber portions 50*a*,50*b*, having an axis 183. The first chamber portion 50*a* and the second chamber portion 50*b* are oriented relative to one another such that the first interface line 59 and the second interface line define a line which intersects the direction of travel 61 at a 45 degree angle.

The winding station 2 includes a conventional yarn end receiving element having a suction tube 24 for applying a suction force through the suction mouth 25. The suction tube 24 is movable to move the suction mouth 25 along a circular arc 26. The yarn end receiving element is operable to receive a yarn end loosened from a yarn package at the unwinding location to convey the yarn end to a yarn delivery component such as the splicing device 22 of the unwinding machine 2.

The yarn end loosening apparatus 31 operates as follows to loosen a yarn end of a yarn package supported on one of the tube support members 38,39,40 and to support the yarn package during subsequent unwinding of the yarn from the yarn package at the winding station 2. The tube support members 38,39,40, each supporting a tube having a yarn package built thereon such as, for example, the yarn packages 36,37 supported on the tube support members 39,40, respectively, are delivered by the delivery assembly 68 to the preliminary location for feeding to the unwinding device 2. In conventional manner, the tube support members 38,39,40 are loaded onto the endless belt of the cross-transport assembly 32 such that they are transported in the direction of travel 61 while arranged serially with respect to each other, as seen in FIG. 1.

As the tube support members 38,39,40 travel in the direction of travel 61 toward the unwinding location, the second chamber portion **50*b* is initially disposed in a clearance position in which it is sufficiently spaced from the cross path to permit the tube support members to be moved therepast by the cross-transport assembly 32. The second chamber portion 50*b* is disposed in its clearance position by appropriate control of the second movement means 65 by the central control unit 73. Specifically, the central control unit 73 controls the second movement means 65 to cause it to be charged with a conventional hydraulic fluid from a conventional hydraulic fluid source (not shown). The charging of the second movement means 65 with hydraulic fluid causes the connector 63 to be retracted into the second movement means 65, thereby displacing the second chamber portion 50*b* laterally toward the same side of the cross-transport assembly 70 as the side on which the second support post 67** is disposed to an extent sufficient for the cylindrical body portion and the enlarged foot portion to be clear of the cross path.

The first chamber portion **50*a* is initially disposed in the chamber forming position whereby it intersects the cross path. The semi-cylindrical body portion and the enlarged foot portion of the first chamber portion 50*a* face in the direction opposite to the direction of travel 61**.

The cross-transport assembly 32 eventually moves the forward-most tube support member 38, as viewed in the direction of travel 61, past the second chamber portion **50*b*, which is disposed in its clearance position, and, further, into contact with the inner surface of the first chamber portion 50*a*. The base cylindrical plate of the tube support member 38 contacts the enlarged foot portion, whereby further travel of the tube support member 38 in the direction of travel 61 is prevented. The tube support member 39, which is the next tube support member following the tube support member 38, has its base cylindrical plate in contact with the base cylindrical plate of the preceding tube support member 38 due to the continuous action of the endless belt of the cross-transport assembly 32**.

The central control unit 73 then controls the second movement means 65 to extend the connector 63 to thereby effect movement of the second chamber portion **50*b* from its clearance position to the chamber forming position in which the second chamber portion 50*b* and the first chamber portion mate along the first engagement line 59 and second engagement line 60 with the yarn package supported on the tube support member 38 supported in upright disposition therebetween. The enlarged foot portion of the second chamber portion 50*b* displaces the tube support members 39 and 40 slightly in the direction opposite to the direction of travel 61 during the movement of the second chamber portion 50*b* from its clearance position to the chamber forming position. Accordingly, once the second chamber portion 50*b* is disposed in the chamber forming position, the enlarged foot portion extends between the respective cylindrical base plates of the tube support member 38 and the tube support member 39** to thereby space the two tube support members from one another.

The gas guide chamber 50 formed by the first chamber portion **50*a* and the second chamber portion 50*b* provides a substantially sealed enclosure along the extent of the yarn package supported on the tube support member 38. Accordingly, once the second portion chamber 50*b* mates with the first chamber portion 50*a* to form the gas guide chamber 50, the central control unit 73 can control the regulating valve 57 to supply compressed gas to the jet nozzles 51,52 and 53. As seen in FIG. 1**, the jet nozzles are oriented to direct jet streams of gas in inclined tangential directions with respect to the yarn package to loosen a yarn end of the yarn package.

The loosened yarn end is directed upwardly under the influence of a helical gas flow which occurs due to the orientation of the jet nozzles 51,52,53 and the cylindrical shape formed by the semi-cylindrical body portions of the first chamber portion **50*a* and the second chamber portion 50*b*. The helical flow of gas eventually lifts the loosened yarn end toward the top of the gas guide chamber 50 for engagement of the yarn end by the suction mouth 25 of the suction device 24. Once the suction device 24 has grasped the loosened yarn end, the suction device 24 signals the central control unit 73 in conventional manner and the central control unit 73 controls the regulating valve 57 to cease the flow of compressed gas from the compressed gas source 58 to the jet nozzles 51,52,53. The central control unit 73 also controls the suction device 24 to swing the suction mouth 25 along the circular arc 26 to deliver the engaged yarn end to the splicing device 22 for subsequent continued unwinding of the yarn from the yarn package disposed within the gas guide chamber 50**.

The circular arc 26 through which the suction mouth 25 of the suction device 24 is moved lies on the lateral plane P. Accordingly, the pivoting of the suction mouth 25 along the circular arc 26 delivers the engaged yarn end to the splicing device 22 and also disposes the yarn between the generally planar portions of the wall members in position for removal of debris around the yarn by the debris removing apparatus 17.

Once the yarn on the yarn package supported on the tube support member 38 has been completely unwound, only an empty tube remains on the tube support member 38. In correspondence with the completion of the unwinding of the yarn package, the central control unit 73 controls the first movement means 64 to retract the connector 62 to thereby move the first chamber portion 50*a* from the chamber forming position to a clearance position in which the first chamber portion is cleared from the cross path sufficiently for the tube support member 38 to be conveyed therepast by the cross-transport assembly 32 toward the discharge location. Additionally, the central control unit 73 controls the second movement means 65 to retract the second chamber portion 50*b* from the chamber forming position to its respective clearing position.

Once the second chamber portion 50*b* reaches its respective clearance position, the next following tube support member 39 is moved by the action of the cross-transport assembly 32 in the direction of travel 61 into the unwinding location. In coordination with the movement of the tube support member 39 into the unwinding location, the central control unit 73 controls the first movement means 64 to move the first chamber portion 50*a* from its respective clearance position to a travel blocking position in which the enlarged foot portion sufficiently extends into the cross path at the unwinding location to prevent further travel of the tube support member 39 in the direction of travel 61.

The movement of the first chamber portion 50*a* from its respective clearance position to the travel blocking position is timed in coordination with the movement of the support member 38, which has just exited the unwinding location, such that the tube support member 38 has traveled sufficiently beyond the first chamber portion 50*a* to preclude the movement of the first chamber portion from its clearance position to the travel blocking position from hindering the movement of the tube support member 38 toward the discharge location. Depending upon the operating circumstances, the travel blocking position of the first chamber portion 50*a* may be substantially coincidental with its chamber forming position. In other operating circumstances, the travel blocking position may entail the positioning of the enlarged foot portion only slightly into the cross path but to a sufficient extent to prevent further travel of the next following tube support member 39. Thereafter, the first chamber portion 50*a* is moved to the chamber forming position.

Once the next following tube support member 39 is positioned at the unwinding location in contact with the first chamber portion 50*a*, the central control unit 73 controls the second movement means 65 to move the second chamber portion 50*b* from its respective clearance position to the chamber forming position. During this movement, the second chamber portion 50*b* contacts the tube support member 40, which is now the next following tube support member with respect to the tube support member 39 at the unwinding location, and displaces the tube support member 40 in a direction opposite to the direction of travel 61 as the second chamber portion moves into the chamber forming position. The enlarged foot portion is now interposed between the respective cylindrical base plates of the tube support members 39,40. In correspondence with the movement of the second chamber portion 50*b* into the chamber forming position, the central control unit 73 controls the regulating valve 57 to supply compressed gas to the jet nozzles 51,52,53 to perform a yarn end loosening operation on the yarn package supported by the tube support member 39.

The debris removing apparatus 17 is mounted to the frame 4 at a location for removing debris from the yarn 12 as it travels beyond the top of the yarn end loosening 31 in advance of engagement of the yarn by a yarn guide 77 disposed immediately below the yarn clearer 18 relative to the direction of travel of the yarn 12. The debris removing apparatus 17 includes an air stream channeling means, an air drive means, and an opposite side opening forming means.

The air stream channeling means includes a first wall member and a second wall member. Each wall member includes a generally planar portion extending substantially parallel to a lateral plane P (shown in FIG. 2). The linear travel path 12" of the traveling yarn 12 lies on the lateral plane P and each of the generally planar portions of the wall members extend on a respective side of the lateral plane P. As seen in FIG. 3, each generally planar portion of the wall members preferably has a lateral extent of approximately 5 centimeters.

Each wall member is preferably formed out of lead and includes a horizontal flange portion 86,88, a vertical tab portion 85,87, and an interconnecting portion 83,84, respectively. The bottom edge of the generally planar portion of each wall member is mounted to the horizontal flange portion 86,88 and extends perpendicularly therefrom. The bottom edge of the vertical tab portion 85,87, of each wall member is mounted to the horizontal flange portion 86,88, respectively, and extends perpendicularly therefrom. The interconnecting portion 83,84 of each wall member includes a vertical edge sealingly connected to a vertical edge of one of the generally planar portions of the wall members and a bottom edge connected to the horizontal flange portion 86,88, respectively. Thus, the interconnecting portion 83,84 interconnects one of the generally planar portions of the wall members with a respective one of the vertical tab portions 85,87.

As seen in FIG. 4, the interconnecting portions 83,84 form an included angle alpha of approximately 60° which is bisected by the lateral plane P.

The means forming an opposite side opening include a suction housing 82 having a projecting portion 81, as seen in FIG. 2, and the suction housing 82 is preferably formed of lead. The suction housing 82 is communicated with the suction source with which the suction device 24 is operatively connected for applying a suction through the suction housing 82.

As seen in FIG. 1, the suction housing 82 is mounted to the frame 4 with its projecting portion 81 projecting laterally parallel to the lateral plane P. As seen in FIG. 2, the free end of the projecting portion 81 is open and the vertical tab portions 85,87 of the wall members are fixedly connected to the projecting portion 81 by conventional securing means such as, for example, welding. As seen in FIGS. 2 and 4, the interconnecting portions 83,84 of the wall members extend to the projecting portion 81 and each has a vertical edge fixed connected to an inner surface of the projecting portion 81.

The interconnecting portions 83,84 of the wall members define therebetween an opposite side opening have an extent b, as measured transversely to the linear travel path 12" and the lateral plane P and have a height h, as seen in FIG. 3 of approximately 8 centimeters. The height h and the extent b of the opposite side opening are selected to provide the opposite side opening with a cross sectional extent relative to the cross sectional extent of the air stream channeling chamber which permits the air stream channel by the air stream channeling chamber toward the yarn 12 to flow around the yarn and entrain debris on and around the yarn 12 for transport away from the yarn.

The generally planar portions of the wall members are coextensive with the linear travel path 12'' in the direction of travel of the yarn 12 and formed therebetween and air stream channeling chamber intersected by the lateral plane P and extending laterally to one side of the linear travel path 12''. The respective vertical edges of the generally planar portions of the wall members opposite the vertical edges connected to the interconnecting portions 83,84 form therebetween an intake opening. As seen in FIG. 4, the width of the air stream channeling chamber as measured transversely to the linear travel path 12'' and the lateral plane P is relatively slightly greater than the cross-sectional extent of the yarn 12.

As seen in FIG. 2, the planar bottom surface of the projecting portion 81 is disposed in the same horizontal plane as the horizontal flange portions 86,88. The horizontal flange portions 86,88 beneficially act as air deflectors.

A yarn sensor 60 is mounted to the bottom surface of the projecting portion 81 for sensing the presence of a yarn extending between the supply package and the debris removing apparatus 17. The yarn sensor 60 can be of a conventional configuration such as, for example, a photoelectric cell. A guide component 89 in the form of a relatively stiff wire is mounted to the top of one of the generally planar portions of the wall members for guiding the traveling yarn 12 into the preferred position between the interconnecting positions 83,84 for cleaning of debris on and around the traveling yarn.

As seen in FIG. 2, a horizontal cover portion 90 is connected to the planar top surface of the projecting portion 81 and to the top horizontal edge of each of the interconnecting portions 83,84. The cover portion 90 forms a yarn guiding recess 91 having an arcuate edge 92 adapted to guide the traveling yarn 12.

As seen in FIG. 1, a conventional slub catcher is mounted to the chamber portion 50*a* and includes an electronically actuable turning magnet 93 and a horizontally extending rod 94 operatedly interconnected to the turning magnet 93 for turning thereby through an angle of approximately 180°. As shown in FIG. 1, the rod 94 extends laterally away from the traveling yarn 12 in its inoperative position. Through actuation of the turning magnet 93, the rod 94 is pivoted through 180° into engagement with the traveling yarn 12 intermediate the top of the chamber 50 and the debris removing apparatus 17 for eliminating slubs from the traveling yarn 12.

The relatively high velocity of the traveling yarn 12 causes the traveling yarn to create a column of air about its circumference which travels with the yarn and carries with it fine debris particles and short fibers which have been separated from the yarn package. For example, a high performance automatic textile winding machine is capable of producing a velocity of over 1,000 meters per minute in the traveling yarn 12. The debris removing apparatus 17 advantageously operates as follows to remove debris on and around the traveling yarn 12 for transport away from the yarn. After the yarn has been disposed between the wall members as previously described by the swinging movement of the suction mouth 25 along the circular arc 26, the central control unit 73 receives a signal from the sensor 60 indicating the presence of the yarn. The central control unit 73 then controls the supply of suction through the intake opening, through the air stream channeling chamber between the generally planar portions of the wall members, into and around the traveling yarn 12 as it travels along the linear travel path 12'', through the opposite side opening 80, the projecting portion 81 and the suction housing 82. The air stream channeling chamber channels the air into an air stream traveling parallel to the lateral plane P toward the yarn 12 as the yarn travels in the linear travel path 12' and this air stream flows around the yarn and entrains debris on and around the yarn for transport away from the yarn through the suction housing 82 to a waste collection site (not shown) at which the debris is collected.

The slub catcher can be advantageously selectively operated to engage the traveling yarn 12 following a yarn break to prevent the traveling yarn from being suctioned into the suction housing 82 during the period of time between the breaking of the yarn and the engagement of the yarn by the suction mouth 25 of the suction device 24. Otherwise, an undesirably lengthy extent of the traveling yarn 12 will be suctioned into the suction housing 82 before the yarn is engaged by the suction mouth 25 for disposition thereby into the splicing device 22. The present invention also contemplates that the slub catcher can be configured with two oppositely movable rods instead of the single rod 94, or can alternatively be configured with a cutter-type mechanism.

In the event that the traveling yarn 12 breaks during its travel between the supply package 31 and the package 9, the suction action of the debris removing apparatus 17 draws the lower yarn end extending from the supply package 31 into the suction housing 82 and thereby exerts a tension on the lower yarn end which advantageously maintains the lower yarn end in a position for ready and accurate engagement by the suction mouth 25 of the suction device 24. As seen in FIGS. 1 and 2, the debris removing apparatus 17 maintains the lower yarn end of the traveling yarn 12 in an upstanding disposition between the top of the supply package 31 and the suction housing 82 so that the suction mouth 25, when it is moved to its yarn engaging position 25', can readily draw in the lower yarn into the suction device 24 for movement thereby into splicing position in the splicing device 22.

Figure 5:
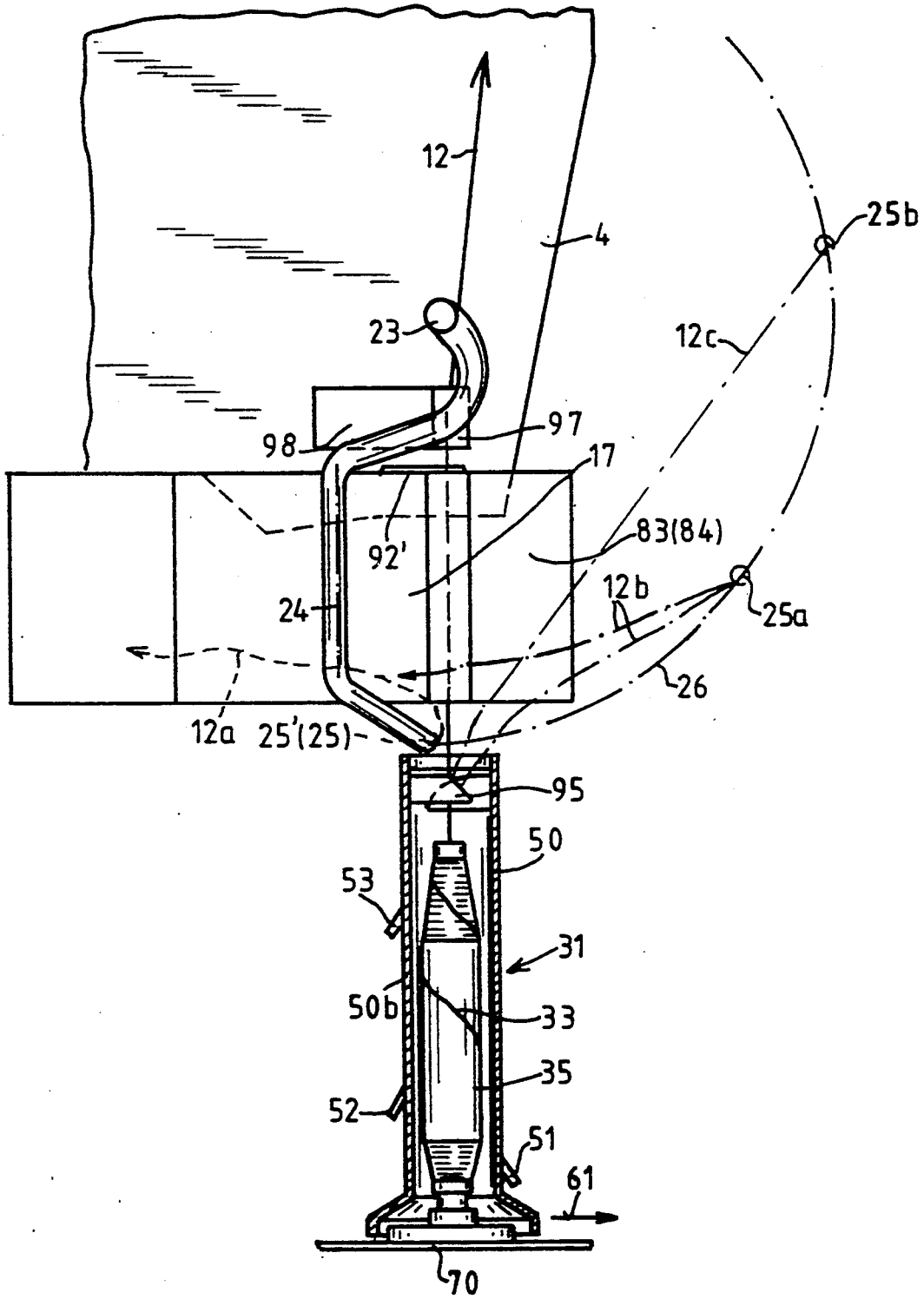
FIG. 5 is an enlarged side elevational view of the debris removing apparatus shown in FIG. 1 and showing, in vertical section, the yarn end loosening apparatus of the textile winding machine in its operative disposition for loosening a yarn end of a supply package.

As illustrated in FIG. 5, in the event of a yarn break between the debris removing apparatus 17 and the package 9, the debris removing apparatus 17 and the suction device 24 cooperate together to continuously maintain the lower yarn extending from the supply package 35 between the first and second wall members. Initially, following a yarn break, the lower yarn end is suctioned into the suction housing 82, as schematically illustrated by the open line 12*a*. Thereafter, when the suction mouth 25 of the suction device 24 engages the lower yarn end at the yarn end engaging position 25' between the debris removing apparatus 17 and the top of the chamber 50, the lower yarn end is correspondingly drawn out from the suction housing 82 during arcuate movement of the suction mouth 25 along the circular arc 26. When the suction mouth 25 reaches the position 25*a* on the circular arc 26, the lower end is in the position schematically illustrated by the dash-dot line 12*b* in which the lower yarn end extends between the first and second wall members. Thereafter, as the suction mouth 25 continues its arcuate movement along the circular arc 26 through another position 25*b* on the circular arc, the lower yarn end continues to be disposed between the first and second wall members, as schematically illustrated by the dash-dot line 12c. Thus, when the lower yarn end is ultimately disposed in the splicing device 22 for splicing with an upper yarn end, the lower yarn end is already disposed between the interconnecting portions 83,84 for removal of debris on and around the yarn when the yarn resumes its travel between the supply package 35 and the package 9.

As seen in FIG. 5, the chamber 50 can be provided with a conventional balloon breaker 95 which simultaneously acts as an accelerator. So, a conventional yarn cleaner 98 can be mounted to the frame 4 above the debris removing apparatus 17 which includes a measuring slot 97 through which the traveling yarn travels immediately after exiting the debris removing apparatus 17. Additionally, the debris removing apparatus 17 can be provided with a yarn guide element 92' mounted to the top surface of the projecting portion 81 for guiding the traveling yarn 12 as it exits the debris removing apparatus 17.

The yarn cleaner 98 can include conventional yarn cutting elements for cutting the traveling yarn 12 in the event that the defective or other out of limit portion of the traveling yarn 12 is detected during the travel of the yarn 12 between the supply package 35 and the package 9.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A textile winding machine comprising:

a winding station having means for winding yarn from a supply package onto another yarn package, the yarn traveling along a linear travel path during at least a portion of its travel between the supply package and the other yarn package; and an apparatus for removing debris traveling with the yarn as it travels from the supply package to the other yarn package, the apparatus including air stream channeling means including an intake opening, a first wall member, and a second wall member, each first and second wall member having a generally planar portion extending substantially parallel to a lateral plane on which the linear travel path lies on a respective side of the lateral plane and each generally planar portions being at least partially coextensive with the linear travel path in the direction of travel of the yarn, the generally planar portions forming therebetween an air stream channeling chamber intersected by the lateral plane and extending laterally to one side of the linear travel path, the air stream channeling chamber being communicated with the intake opening and open toward the yarn traveling along the linear travel path, air drive means for driving air through the intake opening, along the air stream channeling chamber and into and around the yarn traveling along the linear travel path, the air stream channeling chamber channeling air into an air stream traveling parallel to the lateral plane toward the yarn in the linear travel path, and means forming an opposite side opening on the opposite side of the linear travel path as the air stream channeling chamber relative to the lateral plane, the opposite side opening being intersected by the lateral plane and having a cross sectional extent relative to the cross sectional extent of the air stream channeling chamber to permit the air stream channeled by the air stream channeling chamber toward the yarn to flow around the yarn and entrain debris on and around the yarn for transport away from the yarn.

2. The textile winding machine according to claim 1 and further comprising a yarn braking device for controlling the rate of travel of the yarn as it travels between the supply package and the other yarn package, and wherein said means forming an opposite side opening includes a pair of interconnecting portions, each said interconnecting portion being connected to a respective one of said first and second wall members and to said means forming an opposite side opening and each said interconnecting portion defines one edge of said opposite side opening on a respective side of the lateral plane.

3. The textile winding machine according to claim 2 wherein each interconnecting portion extends from the generally planar portion of a respective one of said first and second wall members outwardly relative to the lateral plane to said means forming an opposite side opening.

4. The textile winding machine according to claim 2 and further comprising a means forming a chamber in which the supply package is disposed during winding of yarn therefrom, the chamber extending beyond the top of the supply package relative to the direction of travel of the yarn, and wherein said air stream channeling means is disposed intermediate said chamber forming means and the yarn braking device.

5. The textile winding machine according to claim 2 and further comprising a cover portion extending between, and connected to, said interconnecting portions.

6. The textile winding machine according to claim 5 wherein said cover portion includes a yarn guiding element for guiding the yarn as it travels between the supply package and the other yarn package.

7. The textile winding machine according to claim 1 wherein said generally planar portions of said first and second wall members are at a spacing from one another greater than the cross-sectional extent of the yarn.

8. The textile winding machine according to claim 1 wherein said air drive means is a suction applying device for applying suction through said air stream channeling means.

9. The textile winding machine according to claim 1 and further comprising a yarn end splicing end device and a yarn end engaging device having an arm member pivotally mounted to the textile winding machine for pivoting in a plane parallel to the lateral plane, said arm member forming a suction conduit and a free end of said arm member defining a suction opening at the end of said suction conduit, said arm member being pivotable between a yarn end engaging position in which said suction opening of said arm member is disposed intermediate said debris removing apparatus and said chamber forming means for applying suction to draw a yarn end of the yarn into said suction conduit of said arm member and a yarn transfer position in which said suction opening of said arm member is disposed for positioning the yarn engaged by said arm member in said yarn end splicing device.

10. The textile winding machine according to claim 9 and further comprising a balloon breaking device located intermediate said chamber forming means and said debris removing apparatus.

11. The textile winding machine according to claim 1 and further comprising a slub catcher mounted to said chamber forming means for removing yarn slubs as the yarn travels from the supply package to the other yarn package.

* * * * *